US009468927B2

(12) United States Patent
Dromaretsky et al.

(10) Patent No.: US 9,468,927 B2
(45) Date of Patent: Oct. 18, 2016

(54) COOLING IN A THERMAL CYCLER USING HEAT PIPES

(71) Applicant: APPLIED BIOSYSTEMS, LLC, Carlsbad, CA (US)

(72) Inventors: Alexander Dromaretsky, Davis, CA (US); Thomas C. Au, Palo Alto, CA (US)

(73) Assignee: APPLIED BIOSYSTEMS, LLC, Carlsbad, CA (US)

( * ) Notice: Subject to any disclaimer, the term of this patent is extended or adjusted under 35 U.S.C. 154(b) by 258 days.

(21) Appl. No.: 13/858,840

(22) Filed: Apr. 8, 2013

(65) Prior Publication Data

US 2013/0295654 A1 Nov. 7, 2013

Related U.S. Application Data

(63) Continuation of application No. 12/985,588, filed on Jan. 6, 2011, now abandoned, which is a continuation of application No. 11/767,323, filed on Jun. 22, 2007, now abandoned.

(60) Provisional application No. 60/816,192, filed on Jun. 23, 2006, provisional application No. 60/816,133, filed on Jun. 23, 2006.

(51) Int. Cl.
*B01L 7/00* (2006.01)

(52) U.S. Cl.
CPC ..... *B01L 7/52* (2013.01); *B01L 2300/0636* (2013.01); *B01L 2300/0829* (2013.01); *B01L 2300/0877* (2013.01); *B01L 2300/185* (2013.01);

(Continued)

(58) Field of Classification Search
CPC ..... B01L 7/52; B01L 2300/0636; B01L 2300/0829; B01L 2300/0877; B01L 2300/1822; B01L 2300/1844; B01L 2300/185
USPC ..... 435/6.1, 91.2, 303.1
See application file for complete search history.

(56) References Cited

U.S. PATENT DOCUMENTS

| | | |
|---|---|---|
| 4,950,608 A | 8/1990 | Kishimoto et al. |
| 5,802,856 A | 9/1998 | Schaper et al. |

(Continued)

FOREIGN PATENT DOCUMENTS

| | | |
|---|---|---|
| EP | 0488769 | 6/1992 |
| JP | 2005117987 | 5/2005 |

(Continued)

OTHER PUBLICATIONS

Extended European Search Report for Application No. 12168029.2 dated Oct. 8, 2012.

(Continued)

*Primary Examiner* — Michael Hobbs

(57) ABSTRACT

A device for amplifying a nucleic acid sample may include a sample holder configured to receive a nucleic acid sample, a heating system configured to raise the temperature of the sample, a cooling system configured to lower the temperature of the sample, and a controller configured to operably control the heating system and the cooling system to cycle the device through a desired time-temperature profile. The cooling system may include at least one heat pipe and a heat sink and the at least one heat pipe may include a first portion disposed proximate to the sample holder and a second portion disposed proximate to the heat sink.

12 Claims, 15 Drawing Sheets

(52) U.S. Cl.
CPC . *B01L 2300/1822* (2013.01); *B01L 2300/1844* (2013.01)

(56) References Cited

U.S. PATENT DOCUMENTS

| | | | |
|---|---|---|---|
| 6,015,534 | A | 1/2000 | Atwood |
| 6,103,112 | A | 8/2000 | Sutton et al. |
| 6,226,994 | B1 | 5/2001 | Yamada et al. |
| 2001/0041357 | A1 | 11/2001 | Fouillet et al. |
| 2002/0072112 | A1 | 6/2002 | Atwood et al. |

FOREIGN PATENT DOCUMENTS

| | | |
|---|---|---|
| WO | 01/51209 | 7/2001 |
| WO | 2006/0526852 | 5/2006 |

OTHER PUBLICATIONS

Extended European Search Report for Appl. No. 07812273.6 mailed Mar. 18, 2011.
PCT/US07/071925, International Preliminary Report on Patentability and Written Opinion mailed Jan. 15, 2009.
"Therma-Base Vapor Chamber Technical Data Sheet", *Thermacore Thermal Management Solutions*, 2012, 1-2.

| | Heatsink | Fan | Fan CFM | Noise | Thermal Res. |
|---|---|---|---|---|---|
| 1 | Heat Sink for Nexus AOP-6400 CPU Cooler from Nexus Technology BV (Netherlands) | Nexus SP7025 12M | 21.1 | 19 dBA | 0.25K/W |
| 2 | Heatsink used in Applied Biosystems 7900 HT Fast Real-Time PCR System | Panasonic NMB 4715SL-05W-B50 | 162 | 56.5 dBA | 0.135K/W |
| 3 | Heatsink used in Applied Biosystems 7900 HT Fast Real-Time PCR System | Sunon PMD1209PMB1-A(2) | 120 | 57.6 dBA | 0.114K/W |
| 4 | Cooler Master® Co., Ltd. Hyper 6 (KHC-V81) Heat Pipe CPU Cooler | Hyper 6 (KHC-V81) Stock Fan | Not available | 20 dBA | 0.12K/W |
| 5 | Cooler Master® Co., Ltd. Hyper 6 (KHC-V81) Heat Pipe CPU Cooler | Sunon PMD1209PMB1-A(2) | 120 | 57.6 dBA | 0.078K/W |
| 6 | Thermaltake Co., Ltd. Big Typhoon Heat Pipe CPU Cooler | Thermaltake Stock Fan TT-1225 | Not available | 16 dBA | 0.12K/W |
| 7 | Thermaltake Co., Ltd. Big Typhoon Heat Pipe CPU Cooler | Panasonic NMB 4715SL-05W-B50 | 162 | 56.5 dBA | 0.06K/W |

FIG. 16

COOLING IN A THERMAL CYCLER USING HEAT PIPES

CROSS-REFERENCE TO RELATED APPLICATIONS

This application is a continuation of application Ser. No. 12/985,588 filed Jan. 6, 2011, which is a continuation of application Ser. No. 11/767,323 filed Jun. 22, 2007, which claims a priority benefit under 35 U.S.C. §119(e) from U.S. Patent Application No. 60/816,133 filed Jun. 23, 2006 and Application No. 60/816,192 filed Jun. 23, 2006, all of which are incorporated herein by reference.

FIELD

This disclosure pertains generally to instruments for performing polymerase chain reactions (PCR). More particularly, this disclosure is directed to the use of heat pipe technology for cooling in a thermal cycler configured to perform polymerase chain reactions substantially simultaneously on a plurality of samples. Although PCR is described in detail herein, several other nucleic acid reactions are known in the art including other reactions such as isothermal amplification, ligase chain reaction (LCR), antibody binding reaction, oligonucleotide ligations assay (OLA), and hybridization assay.

INTRODUCTION

To amplify DNA (Deoxyribose Nucleic Acid) using the PCR process, a specially constituted liquid reaction mixture is cycled through a PCR protocol that includes several different temperature incubation periods. The reaction mixture is comprised of various components such as the DNA to be amplified and at least two primers selected in a predetermined way so as to be sufficiently complementary to the sample DNA as to be able to create extension products of the DNA to be amplified. The reaction mixture includes various enzymes and/or other reagents, as well as several deoxyribonucleoside triphosphates such as dATP, dCTP, dGTP and dTTP. Generally, the primers are oligonucleotides which are capable of acting as a point of initiation of synthesis when placed under conditions in which synthesis of a primer extension product which is complimentary to a nucleic acid strand is induced, i.e., in the presence of nucleotides and inducing agents such as thermostable DNA polymerase at a suitable temperature and pH.

A significant aspect to PCR is the concept of thermal cycling; that is, alternating steps of melting DNA, annealing short primers to the resulting single strands, and extending those primers to make new copies of double stranded DNA. In thermal cycling, the PCR reaction mixture is repeatedly cycled from high temperatures of about 90° C. for melting the DNA, to lower temperatures of approximately 40° C. to 70° C. for primer annealing and extension. The details of the polymerase chain reaction, the temperature cycling and reaction conditions necessary for PCR as well as the various reagents and enzymes necessary to perform the reaction are described in U.S. Pat. Nos. 4,683,202, 4,683,195, and 4,889,818, and in EPO Publication 258,017, the entire disclosures of which are hereby incorporated by reference herein.

The purpose of a polymerase chain reaction is to manufacture a large volume of DNA which is identical to an initially supplied small volume of "seed" DNA. The reaction involves copying the strands of the DNA and then using the copies to generate other copies in subsequent cycles. Under ideal conditions, each cycle will double the amount of DNA present thereby resulting in a geometric progression in the volume of copies of the "target" or "seed" DNA strands present in the reaction mixture.

A typical PCR temperature cycle requires that the reaction mixture be held accurately at each incubation temperature for a prescribed time and that the identical cycle or a similar cycle be repeated many times. A typical PCR program starts at a sample temperature of about 94° C. held for 30 seconds to denature the reaction mixture. Then, the temperature of the reaction mixture is lowered to about 37° C. and held for one minute to permit primer hybridization. Next, the temperature of the reaction mixture is raised to a temperature in the range from about 50° C. to about 72° C., where it is held for two minutes to promote the synthesis of extension products. This completes one cycle. The next PCR cycle then starts by raising the temperature of the reaction mixture to about 94° C. again for strand separation of the extension products formed in the previous cycle (denaturation). Typically, the cycle is repeated 25 to 40 times.

Generally, it is desirable to change the sample temperature to the next temperature in the cycle as rapidly as possible for several reasons. First, the chemical reaction has an optimum temperature for each of its stages. Thus, less time spent at non-optimum temperatures may achieve a better chemical result. Another reason is that a minimum time for holding the reaction mixture at each incubation temperature is required after each said incubation temperature is reached. These minimum incubation times establish the "floor" or minimum time it takes to complete a cycle. Any time transitioning between sample incubation temperatures is time added to this minimum cycle time. Since the number of cycles is fairly large, this additional time undesirably lengthens the total time needed to complete the amplification.

In some conventional automated PCR instruments, to perform the PCR process, the temperature of a metal block which holds containers, holders, or the like containing samples, is controlled according to prescribed temperatures and times specified by the user in a PCR protocol file. A computer and associated electronics control the temperature of the metal block in accordance with the user supplied data in the PCR protocol file defining the times, temperatures and number of cycles, etc. As the metal block changes temperature, the samples held in the various sample containers or holders may follow with similar changes in temperature. However, in these conventional instruments not all samples experience the same temperature cycle. In these conventional PCR instruments, errors in sample temperature may be generated by nonuniformity of temperature from place to place within the metal sample block, i.e., temperature variability exists within the metal of the block thereby undesirably causing some samples to have different temperatures than other samples at particular times in the cycle. Further, there may be delays in transferring heat from the block to the sample, but the delays may not be the same for all samples.

In other conventional automated PCR systems, sample holders, for example, capillaries, may be heated and/or cooled without the use of a metal block. For example, in such systems, air or other fluid may be circulated directly around the holders. The temperature of the samples in such systems also may be relatively difficult to control, e.g., such that all of the samples reach the same temperature and/or change temperatures substantially simultaneously. In other words, in such systems, undesirable temperature variations among the samples may occur. Further, it may be difficult to change the temperature of the samples in an efficient manner using direct cooling and/or heating via circulating fluid.

To perform the PCR process successfully and efficiently, and to enable so called "quantitative" PCR, it is desirable to minimize such time delays and temperature errors (e.g., undesirable temperature variations) that may occur in conventional systems.

The problems of minimizing time delays for heat transfer to and from the samples and minimizing temperature errors due to undesirable temperature variability (nonuniformity) may become particularly acute when the size of the region containing samples becomes large. It is a desirable attribute for a PCR instrument to be configured to accommodate sample holders (e.g., tubes, wells, containers, recesses, capillaries, sample locations, etc., for example, of microtiter plates, microcards, individual capillary tubes) that comply with industry standard formats in both number and arrangement (e.g., 48-, 96-, 384-, 768-, 1536-, 6144- etc. holder format).

One widely used means for handling, processing and analyzing large numbers of small (e.g., microvolume) samples in the biochemistry and biotechnology fields includes the microtiter plate. In an exemplary arrangement, a microtiter plate is a tray which is 3⅝ inches wide and 5 inches long and contains 96 identical sample wells in an 8 well by 12 well rectangular array on 9 millimeter centers. Although microtiter plates are available in a wide variety of materials, shapes, volumes, and numbers of the sample wells, which are optimized for many different uses, microtiter plates typically have the same overall outside dimensions. A wide variety of equipment is available for automating the handling, processing and analyzing of samples in this standard microtiter plate format. Although 96-well plate formats are commonly used, microtiter plates in other formats also may be used, including, for example, 48-, 384, 768-, 1536-, 6144-, etc. well formats.

Furthermore, there are numerous other types of sample holders that may be used in lieu of micro titer plates. By way of example only, samples may be held in a plurality of capillaries, capped disposable tubes, and in various flat microcards where plural samples are collected (e.g., spotted) at predetermined locations on the surface of the microcard.

It is therefore a desirable characteristic for a PCR instrument to be able to perform the PCR reaction on numerous samples simultaneously, wherein the samples are arranged and held in a format, such as, for example, any of the various formats discussed above and known to those having skill in the art.

When using a metal block to conduct heat with the samples, the size of such a block which is necessary to heat and cool, for example, at least 96 samples in an 8×12 well array on 9 millimeter centers, is fairly large. This large area block creates multiple challenging engineering problems for the design of a PCR instrument that is capable of heating and cooling such a block very rapidly in a temperature range generally from 0° C. to 100° C. and with very little tolerance for temperature variations between samples. These problems arise from several sources. First, the large thermal mass of the block makes it difficult to move the block temperature up and down in the operating range with great rapidity. Second, in some conventional instruments, the need to attach the block to various external devices such as manifolds for supply and withdrawal of cooling fluid, block support attachment points, and associated other peripheral equipment creates the potential for temperature variations to exist across the block which exceed tolerable limits.

There are also numerous other conflicts between the requirements in the design of a thermal cycling system for automated performance of the PCR reaction or other reactions requiring rapid, accurate temperature cycling of a large number of samples. For example, to change the temperature of a metal block and/or the samples rapidly, a large amount of heat must be added to, or removed from the block and/or the samples in a short period of time. In some conventional instruments, heat can be added from electrical resistance heaters, while in others, heat can be added by flowing a heated fluid into contact with the block. Similarly, in some conventional instruments, heat can be removed by flowing a chilled fluid into contact with the block and/or the sample holders, while in others, heat can be removed by a heat sink and fan combination. However, it may be difficult to add or remove large amounts of heat rapidly and efficiently by these means without causing large differences in temperature from place to place in the block and/or the sample holders thereby forming temperature variability which can result in nonuniformity of temperature among the samples.

Further, in conventional instruments, the heat sink, sample holders, and sample block, if any, are typically positioned in a central portion of the instrument. In some cases, this central positioning may be necessary due to the location of optics and other detection mechanisms that detect the reactions taking place in the sample holders. In such cases, the air path between the fan and the heat sink, the sample holders, and/or the sample block may be relatively long, as the fan is typically positioned either externally to the instrument or proximate a periphery of the instrument. To provide sufficient cooling, therefore, a relatively powerful, and thus relatively loud, fan may be required. Thus, it may be desirable to reduce (e.g., minimize) the length of the air path between the fan and the heat sink and/or to position the heat sink in a location proximate a periphery of the instrument rather than in a center of the instrument.

Even after the process of addition or removal of heat is terminated, temperature variability can persist for a time roughly proportional to the square of the distance that the heat stored in various points in the block must travel to cooler regions to eliminate the temperature variance. Thus, as a metal block is made larger to accommodate more samples, the time it takes for temperature variability existing in the block to decay after a temperature change causes temperature variance which extends across the largest dimensions of the block can become markedly longer. This makes it increasingly difficult to cycle the temperature of the sample block rapidly while maintaining accurate temperature uniformity among all the samples.

Because of the time required for temperature variations to dissipate, an important need has arisen in the design of a high performance PCR instruments to prevent the creation of undesired temperature variablity that may extend over large distances. Thus, it may be desirable to provide a thermal cycler for performing PCR, wherein the sample block can be cooled in a rapid, efficient, and uniform manner. It also may be desirable to provide a thermal cycler for performing PCR wherein the sample holders can be directly cooled and/or heated in an efficient and rapid manner, for example, without the use of a metal block. It may be desirable to provide a thermal cycler that is capable of achieving sub-ambient temperatures.

On the other hand, there may be a need in some applications of a thermal cycler to create desired temperature gradients among the samples, e.g., at certain locations of the sample holders or sample block. Thus, it may be desirable to provide a thermal cycler with a cooling system capable of creating desired temperature gradients (e.g, controlled temperature gradients).

SUMMARY

The present invention may satisfy one or more of the above-mentioned desirable features. Other features and/or advantages may become apparent from the description which follows.

According to various exemplary aspects of the disclosure, a device for performing polymerase chain reactions in a nucleic acid sample can include a sample holder configured to receive a nucleic acid sample, a heating system configured to raise the temperature of the sample, a cooling system configured to lower the temperature of the sample, and a controller configured to operably control the heating system and the cooling system to cycle the device through a desired time-temperature profile. The cooling system can include at least one heat pipe.

According to yet further exemplary embodiments, a device for amplifying a nucleic acid sample may include a sample holder configured to receive a nucleic acid sample, a heating system configured to raise the temperature of the sample, a cooling system configured to lower the temperature of the sample, and a controller configured to operably control the heating system and the cooling system to cycle the device through a desired time-temperature profile. The cooling system may include at least one heat pipe and a heat sink and the at least one heat pipe may include a first portion disposed proximate to the sample holder and a second portion disposed proximate to the heat sink.

In accordance with yet other exemplary embodiments, a device for amplifying a nucleic acid sample may include a sample holder configured to receive a nucleic acid sample, a heating system configured to raise the temperature of the sample, a cooling system configured to lower the temperature of the sample, and a controller configured to operably control the heating system and the cooling system to cycle the device through a desired time-temperature profile. The cooling system may include at least one heat pipe, a heat sink, and a fan, and the heat sink may be positioned in an air path of the fan between the fan and a center of the device.

In accordance with yet other exemplary embodiments, a device for performing biological sample processing, may comprise: an enclosure configured to receive a biological sample for processing; and a thermal system configured to modulate a temperature of the biological sample, the thermal system comprising a cooling system configured to lower a temperature of the biological sample, wherein the cooling system comprises a fan and wherein the cooling system is configured to minimize a physical disturbance associated with the fan during cooling.

In accordance with yet other exemplary embodiments, a method for performing biological sample processing, may comprise: supplying an enclosure with a biological sample for processing; and modulating a temperature of the biological sample to cycle a temperature of the biological sample, wherein modulating the temperature comprises recirculating a cooling fluid fluid between a first location offset from the enclosure and a second location proximate the enclosure, the cooling fluid absorbing heat at the second location to lower the temperature of the biological sample.

In accordance with yet other exemplary embodiments, a device for biological sample processing may comprise: an enclosure configured to receive a biological sample for processing; and a thermal system configured to modulate a temperature of the biological sample, the thermal system comprising a cooling system configured to lower a temperature of the biological sample, wherein the cooling system comprises at least one cooling fluid recirculation mechanism configured to recirculate cooling fluid between a first location offset from the enclosure and a second location proximate the enclosure, wherein the cooling fluid absorbs heat at the second location to lower the temperature of the biological sample.

In accordance with yet other exemplary embodiments, a device for biological sample processing, may comprise: a sample holder configured to receive a biological sample; a heating system configured to raise the temperature of the sample; a cooling system configured to lower the temperature of the sample; and a controller configured to operably control the heating system and the cooling system to cycle the device through a desired time-temperature profile, wherein the cooling system comprises at least one heat pipe, a heat sink, and a fan, and wherein the heat sink is positioned in an air path of the fan between the fan and a center of the device.

In accordance with yet other exemplary embodiments, a device for biological sample processing, may comprise: a sample holder configured to receive a biological sample; a heating system configured to raise the temperature of the biological sample; a cooling system configured to lower the temperature of the biological sample; and a controller configured to operably control the heating system and the cooling system to cycle the device through a desired time-temperature profile, wherein the cooling system comprises at least one heat pipe and a heat sink, and wherein the at least one heat pipe comprises a first portion disposed proximate to the sample holder and a second portion disposed proximate to the heat sink.

In the following description, certain aspects and embodiments will become evident. It should be understood that the invention, in its broadest sense, could be practiced without having one or more features of these aspects and embodiments. It should be understood that these aspects and embodiments are merely exemplary and explanatory and are not restrictive of the invention.

BRIEF DESCRIPTION OF THE DRAWINGS

FIG. 16 is a table comparing air flow volumes, noise levels, and thermal resistances for differing heat sink and fan cooling combinations.

DETAILED DESCRIPTION OF VARIOUS EMBODIMENTS

Reference will now be made to various embodiments, examples of which are illustrated in the accompanying drawings. However, these various exemplary embodiments are not intended to limit the disclosure. On the contrary, the disclosure is intended to cover alternatives, modifications, and equivalents.

With respect to containers, holders, chambers, wells, recesses, tubes, capillaries and/or locations used in conjunction with plates, trays, cards, and/or alone, as used herein, such structures may be "micro" structures, which refers to the structures being configured to hold a small (micro) volume of fluid; e.g., no greater than about 250 μl to about 300 μl. In various embodiments, such structures are configured to hold no more than 100 μl, no more than 75 μl, no more than 50 μl, no more than 25 μl, or no more than 1 μl. In some embodiments, such structures can be configured to hold, for example, about 30 μl.

Figure 1A:
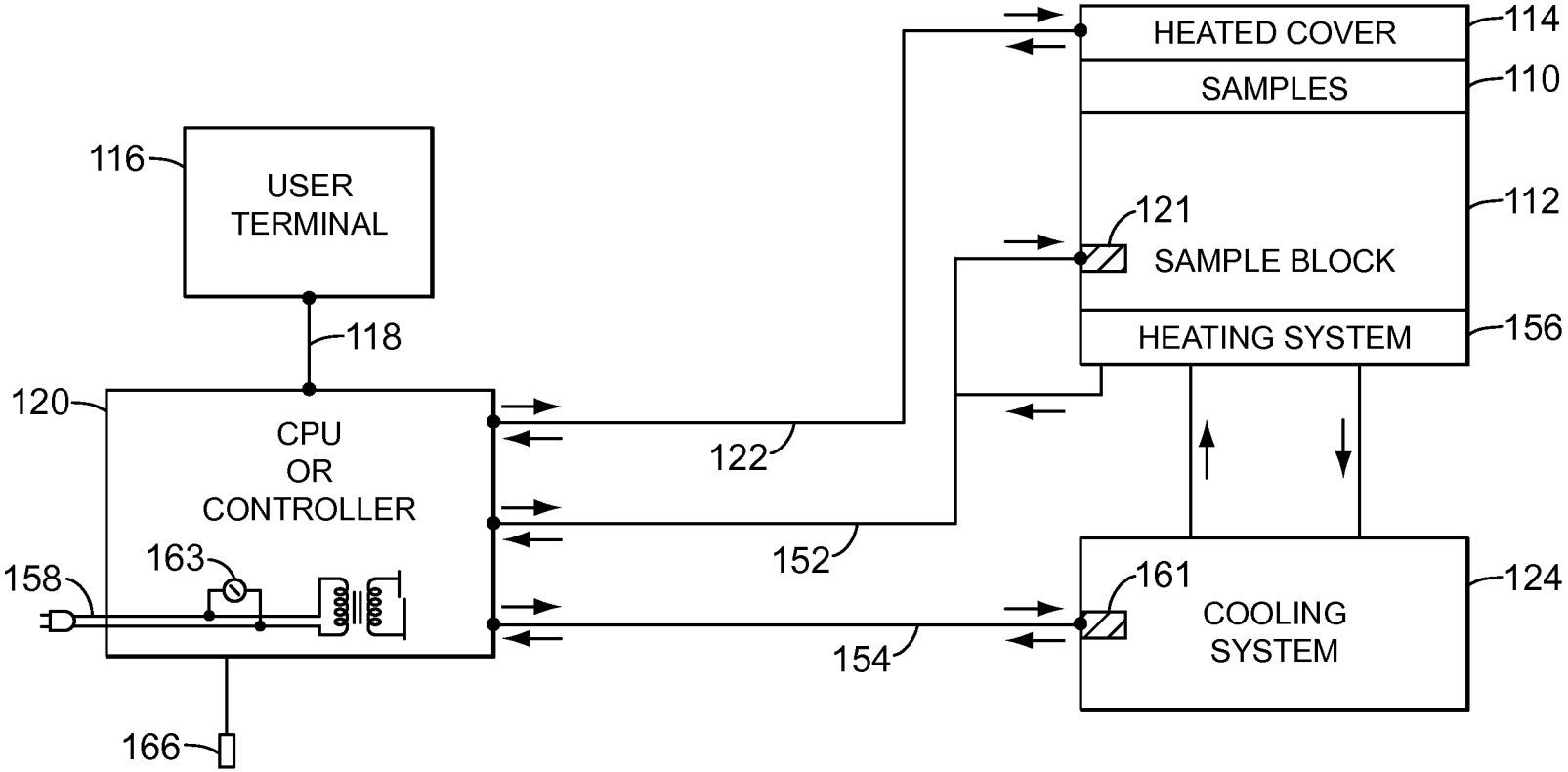
FIG. 1A is a block diagram of a thermal cycler in accordance with an exemplary embodiment.
Figure 1B:
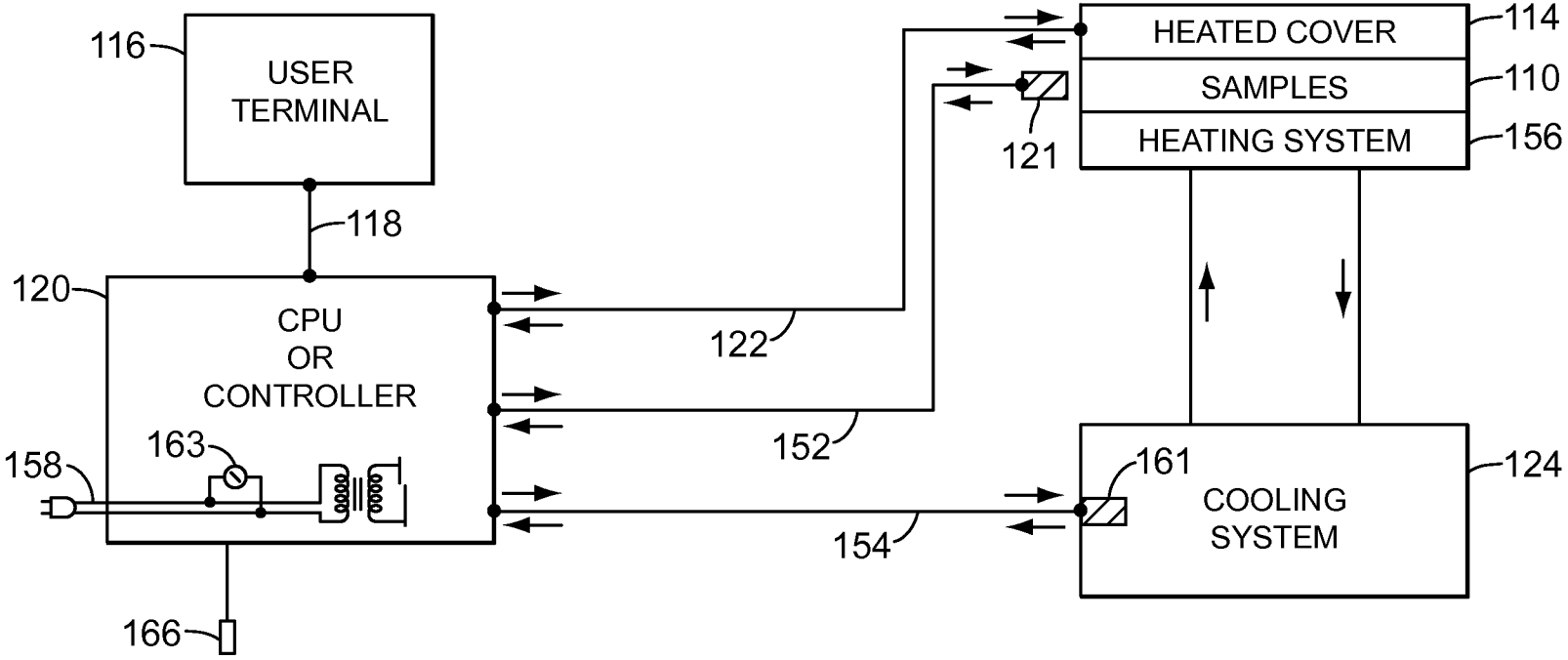
FIG. 1B is a block diagram of a thermal cycler in accordance with another exemplary embodiment.

Referring to FIGS. 1A and 1B, a block diagram of the major system components of exemplary embodiments of a thermal cycler for performing PCR according to the exemplary aspects of the disclosure is shown. With reference to FIG. 1A, sample mixtures, including the DNA to be amplified, are placed in the temperature-programmed sample block 112 and are covered by a heated cover 114. The sample block may be a metal block constructed, for example, from silver. With reference to FIG. 1B, another exemplary embodiment of a thermal cycler for performing PCR is illustrated. This embodiment does not include a sample block. Rather, the samples are directly heated and/or cooled.

With either embodiment, a user may supply data defining time and temperature parameters (e.g., time-temperature profiles) of the desired PCR protocol via a terminal 116 including a keyboard and display. The keyboard and display are coupled via a data bus 118 to a controller 120 (sometimes referred to as a central processing unit or CPU). The controller 120 can include memory that stores a desired control program, data defining a desired PCR protocol, and certain calibration constants. Based on the control program, the controller 120 controls temperature cycling of the sample block 112 and/or holders containing the samples 110 and implements a user interface that provides certain displays to the user and receives data entered by the user via the keyboard of the terminal 116. It should be appreciated that the controller 120 and associated peripheral electronics to control the various heaters and other electro-mechanical systems of the thermal cycler and read various sensors can include any general purpose computer such as, for example, a suitably programmed personal computer or microcomputer.

Samples 110 can be held in a sample holder (e.g., in microcards, microplates, capillaries, etc.) configured to be seated in the sample block 112 and thermally isolated from the ambient air by the heated cover 114, which contacts a plastic disposable tray to form a heated, enclosed box in which the sample holders reside. The sample holders may include, for example, recesses and/or wells in a microtiter plate, capillaries, locations for holding samples on a microcard, and/or other conventional sample holders used for PCR processes. The heated cover serves, among other things, to reduce undesired heat transfer to and from the sample mixture by evaporation, condensation, and refluxing inside the sample tubes. It also may reduce the chance of cross-contamination by maintaining the insides of the caps of capillary tubes dry thereby preventing aerosol formation when the tubes are uncapped. The heated cover may be in contact with the sample tube caps and/or other sealing mechanism over the sample holders so as to keep them heated to a temperature of approximately 104° C. or above the condensation points of the various components of the reaction mixture.

The controller 120 can include appropriate electronics to sense the temperature of the heated cover 114 and control electric resistance heaters therein to maintain the cover 114 at a predetermined temperature. Sensing of the temperature of the heated cover 114 and control of the resistance heaters therein is accomplished via a temperature sensor (not shown) and a data bus 122.

A cooling system 124, examples of which are discussed in more detail below, can provide precise temperature control of the samples 110. According to some aspects, the cooling system 124 can be operated to achieve fast, efficient, and/or uniform temperature control of the samples 110. According to some aspects, the cooling system 124 can be operated to quickly and/or efficiently achieve a desired temperature gradient between various samples.

According to various aspects, the apparatus of FIGS. 1A and 1B can be enclosed within a housing (not shown). Any heat being expelled to the ambient air can be kept within the housing to aid in evaporation of any condensation that may occur. This condensation can cause corrosion of metals used in the construction of the unit or the electronic circuitry and should be removed. Expelling the heat inside the enclosure helps evaporate any condensation to prevent corrosion.

As noted above, the PCR protocol may involve incubations at at least two different temperatures and often three different temperatures. These temperatures are substantially different, and, therefore, means must be provided to move the temperature of the reaction mixture of all the samples rapidly from one temperature to another. The cooling system 124 is configured to reduce the temperature of the samples 110 from the high temperature denaturation incubation to the lower temperature hybridization and extension incubation temperatures. For example, the cooling system 124 may lower the temperature of the sample block 112 (FIG. 1A) or may act to directly lower the temperature of holders containing the samples 110 (FIG. 1B), It should be appreciated that a ramp cooling system, in some exemplary embodiments, may also be used to maintain the sample temperature at or near the target incubation temperature. However, in some embodiments, small temperature changes in the downward direction to maintain target incubation temperature are implemented by a bias cooling system (e.g., a Peltier thermoelectric device), as is known to those skilled in the art.

A heating system 156, for example, a multi-zone heater, can be controlled by the controller 120 via a data bus 152 to rapidly raise the temperature of the sample block 112 and/or the sample holders to higher incubation temperatures from lower incubation temperatures. The heating system 156 also may correct temperature errors in the upward direction during temperature tracking and control during incubations.

The heating system may include but is not limited to, for example, film heaters, resistive heaters, heated air, infrared heating, convective heating, inductive heating (e.g. coiled wire), Peltier based thermoelectric heating, and other heating mechanisms known to those skilled in the art. According to various exemplary embodiments, the cooling system and the heating system may be a single system configured to both increase and decrease the temperature of the block 112 and/or of the sample holders directly.

In the exemplary embodiment of FIG. 1A, the controller 120 controls the temperature of the sample block 112 by sensing the temperature of the sample block 112 and/or fluid circulating within the sample block 112 via a temperature sensor 121 and the data bus 152 and by sensing the temperature of the cooling system 124 via bus 154 and a temperature sensor 161 in the cooling system 124. By way of example only, the temperature of the circulating fluid of the cooling system may be sensed, although other temperatures associated with the cooling system may also be sensed. In the exemplary embodiment of FIG. 1B, the controller 120 may control the temperature of the samples 110 by sensing the temperature of the samples 110 via a sensor 121 and the data bus 152. The sensor 121 in the embodiment of FIG. 1B may be, for example, a remote infrared temperature sensor or an optical sensor that detects a thermochromic dye in the samples 110. The controller 120 can also sense the internal ambient air temperature within the housing of the system via an ambient air temperature sensor 166. Further, the controller 120 can sense the line voltage for the input power on line 158 via a sensor 163. All these items of data together with items of data entered by the user to define the desired PCR protocol such as target temperatures and times for incubations are used by the controller 120 to carry out a desired temperature/time control program.

Figure 2:
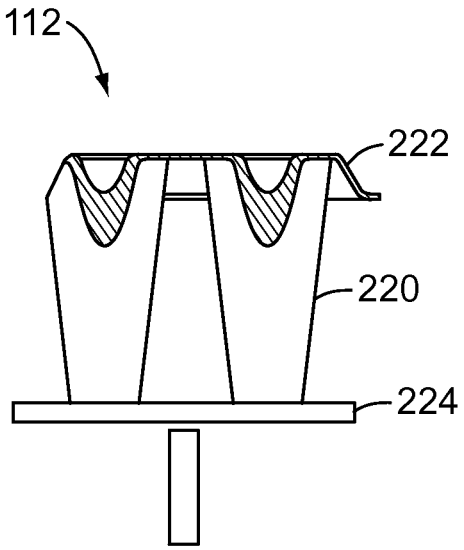
FIG. 2 is a cross-sectional view of a portion of an exemplary embodiment of a sample block of a thermal cycler.

Referring now to FIG. 2, a cross-sectional view of a portion of an exemplary embodiment of the sample block 112 is illustrated. The sample block 112 can include a plurality of recesses 220 configured to accommodate the number and arrangement of the sample holder being used. For example, if a 96-well microtiter plate is being used, the sample block 112 may be provided with ninety-six (96) recesses 220 in a standard 12×8 configuration to accommodate, for example, the 96-well tray. Those having skill in the art would understand a variety of other configurations (e.g., number and arrangement) for the recesses 220 in order to accommodate other sample holder formats. Each of the recesses 220 may be configured to receive a sample well, capillary tube, or other sample holding structure. The sample block 112 can include a one-piece structure including an upper support plate 222 and the recesses 220 may be fastened to a base plate 224, for example, by electroforming. The base plate 224 can provide lateral conduction to compensate for any differences in the thermal power output across the surface of each individual thermal electric device 360, shown in FIG. 3, and for differences from one thermal electric device to another. Alternatively, the sample block can be flat without recesses and configured to accommodate a microcard or flat-bottomed tray.

Figure 3:
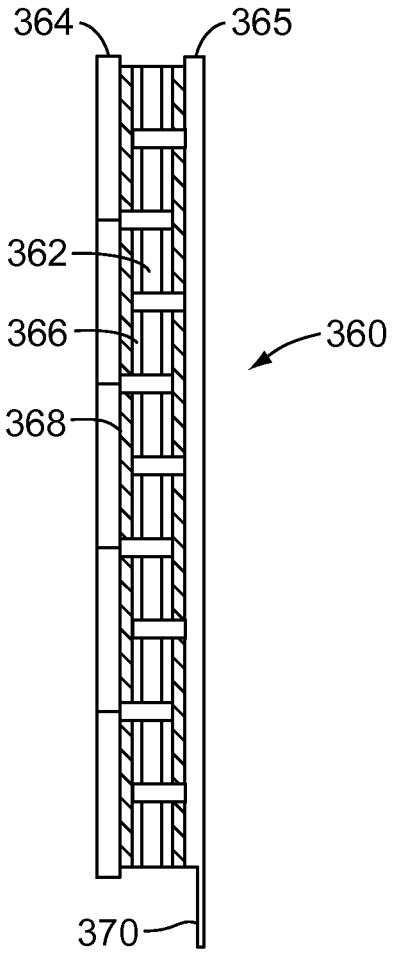
FIG. 3 is a partial, side, elevational view of an exemplary embodiment of a thermal electric device.

According to various exemplary embodiments, the heating system 156 may be, for example, a Peltier thermoelectric device 360, as shown in FIG. 3. The device 360 may include bismuth telluride couples 362 (for example, in the form of cube-like structures) sandwiched between two alumina layers 364, 365. The couples 362 can be electrically connected by solder joints 366 to copper traces 368 plated onto the alumina layers. One alumina layer can have an extension 370 to facilitate electrical connections. The thickness of the extended area can be reduced to decrease the thermal load of the device.

Figure 4:
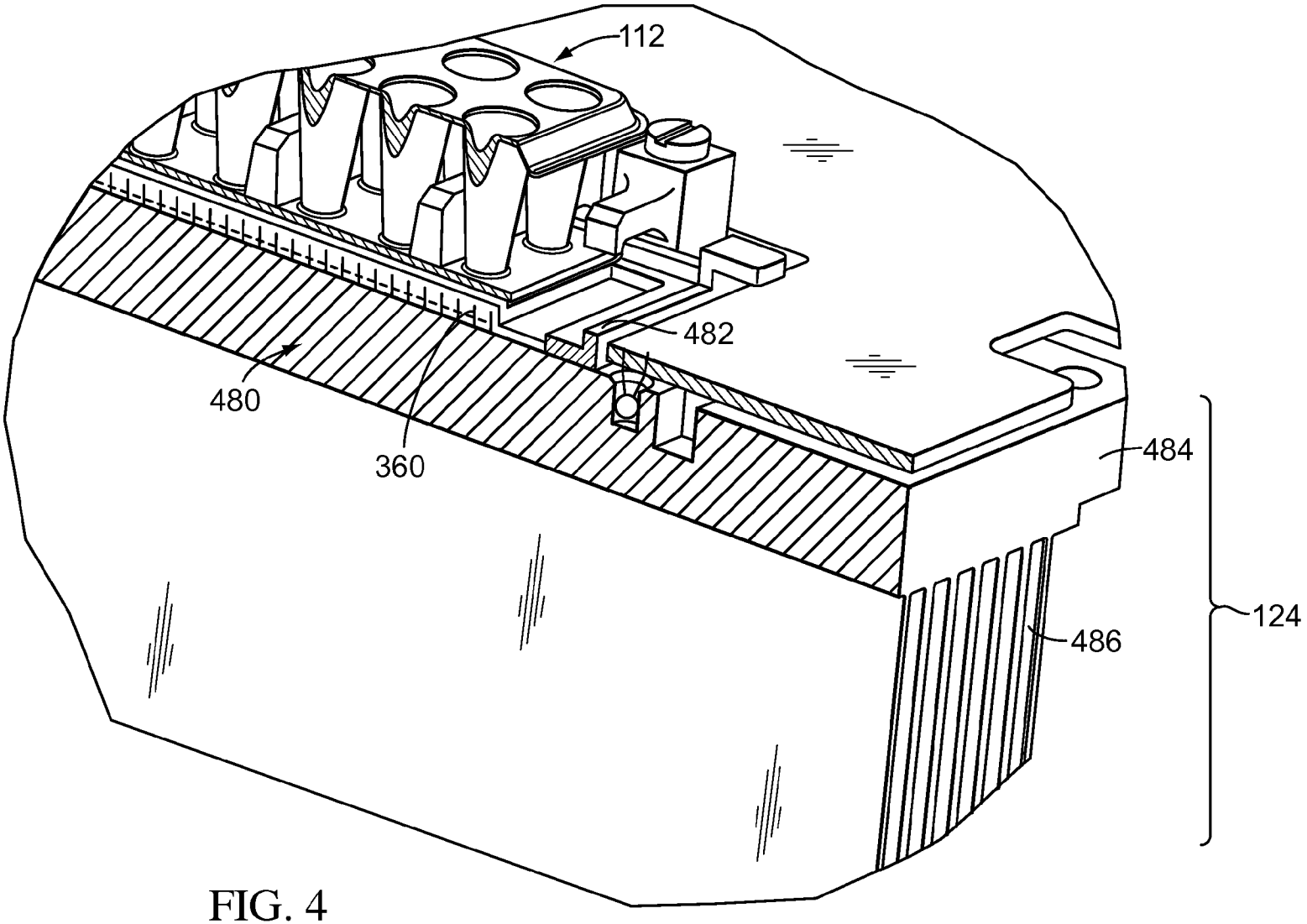
FIG. 4 is a cut-away, partial, isometric view of an exemplary embodiment of a heat sink.

Referring now to FIG. 4, in various exemplary embodiments, the cooling system 124 can comprise a heat sink 480 assembled with the thermoelectric device 360 and the sample block 112. A locating frame 482 can be positioned around the thermoelectric device 360 to align it with the sample block 112 and the heat sink 480 to maximize temperature uniformity across the sample block, when desired. The heat sink 480 can comprise a substantially planar base 484 (e.g., heat sink block) and fins 486 extending from the base 484. The thermal mass of the heat sink is considerably larger than the thermal mass of the sample block 112 and samples 110 combined. As a result, the sample block 112 may change temperature significantly faster than the heat sink 480 for a given amount of heat transferred by the heating system 156.

Figure 5:
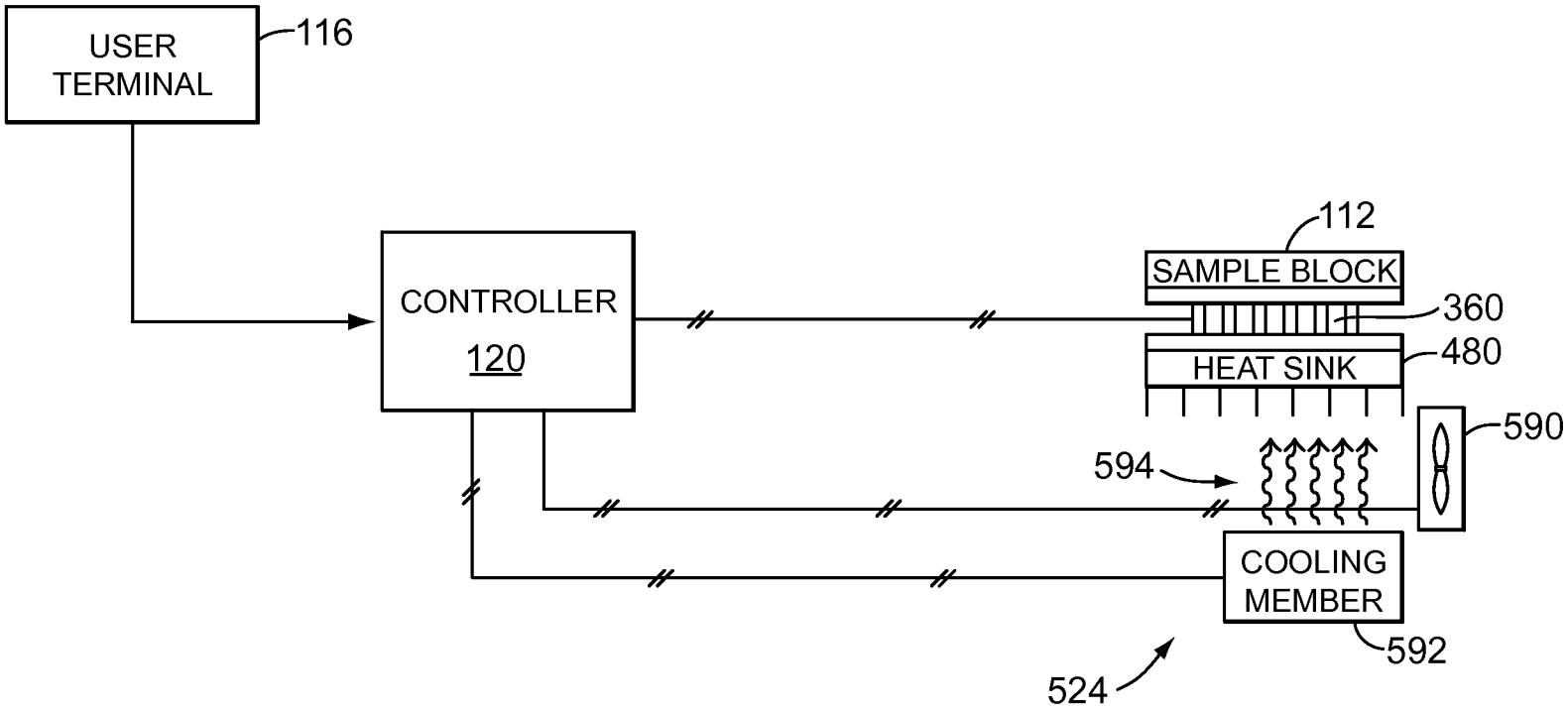
FIG. 5 is a block diagram of an exemplary embodiment of a cooling system of a thermal cycler in accordance with aspects of the disclosure.

As shown in FIG. 5, according to some exemplary embodiments, a cooling system 524 can include a fan 590 and/or at least one cooling member 592 configured to control the heat sink temperature. The fan 590 and/or the cooling member 592 can be operably controlled, for example, by the controller 120. According to some aspects, the fan 590 and/or the cooling member 592 can be operated to hold the heat sink 480 at approximately 45° C., which is well within the normal PCR cycling temperature range. In some aspects, maintaining a stable heat sink temperature can improve repeatability of system performance.

According to some exemplary embodiments, the cooling member 592 can be configured to lower the temperature of the ambient air being directed toward the heat sink 480 by the conventional fan 590. As shown in FIG. 5, the cooling member 592 can lower the ambient air temperature by outputting a cooling fluid 594 such as, for example, CO2 (bottled or dry), liquid nitrogen, pressurized air, a chilled gas (e.g., cold gas from liquid nitrogen), water, or the like into the airflow path of the fan 590.

Figure 6:
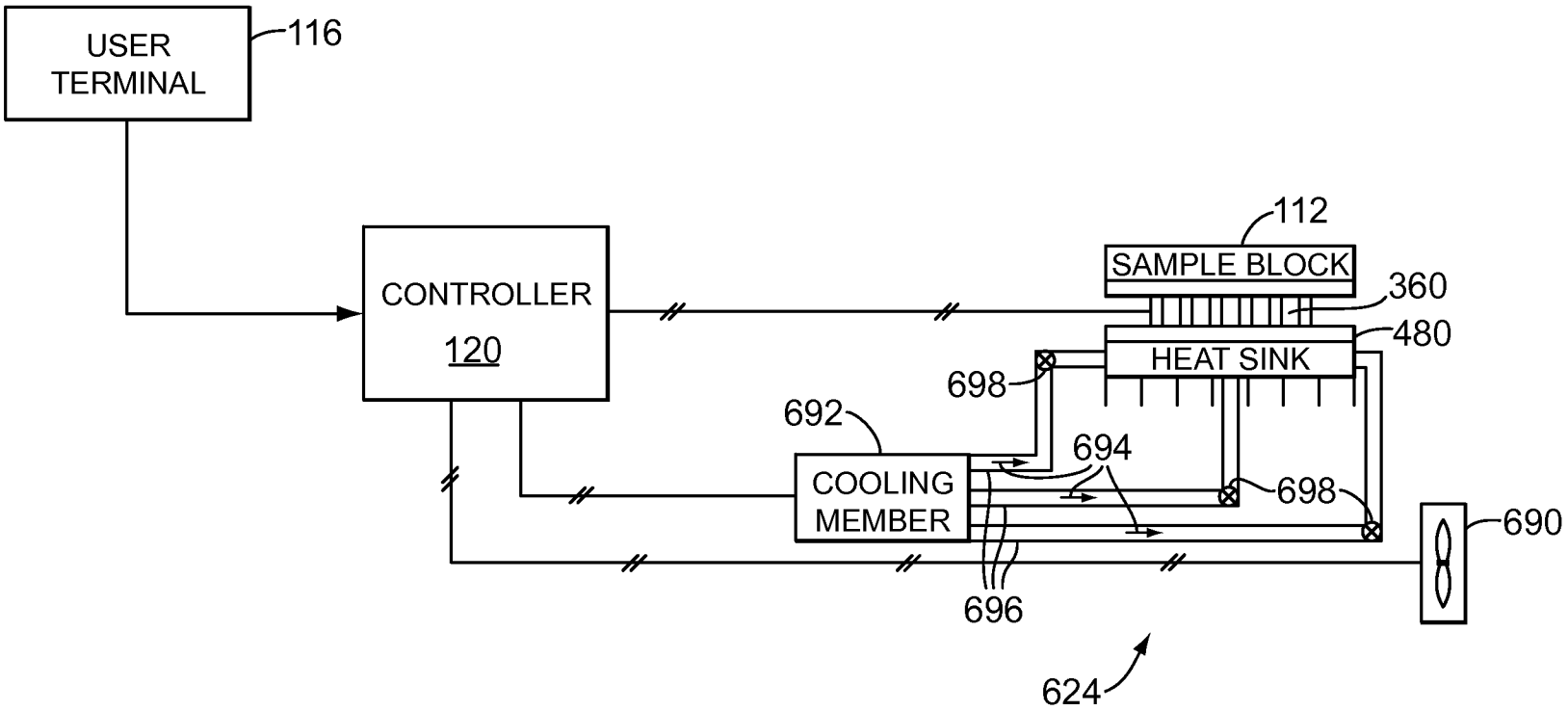
FIG. 6 is a block diagram of an exemplary embodiment of a cooling system of a thermal cycler in accordance with aspects of the disclosure.

Referring now to FIG. 6, a cooling system 624 can comprise at least one cooling member 692 configured to output a cooling fluid 694 such as, for example, CO2 (bottled or dry), liquid nitrogen, pressurized air, water, or the like to a series of plumbing 696 and valves 698 configured to direct the cooling fluid to one or more regions of the heat sink 480. According to some aspects, cooling system 624 can also include a conventional fan 690 to control the heat sink temperature.

Figure 7:
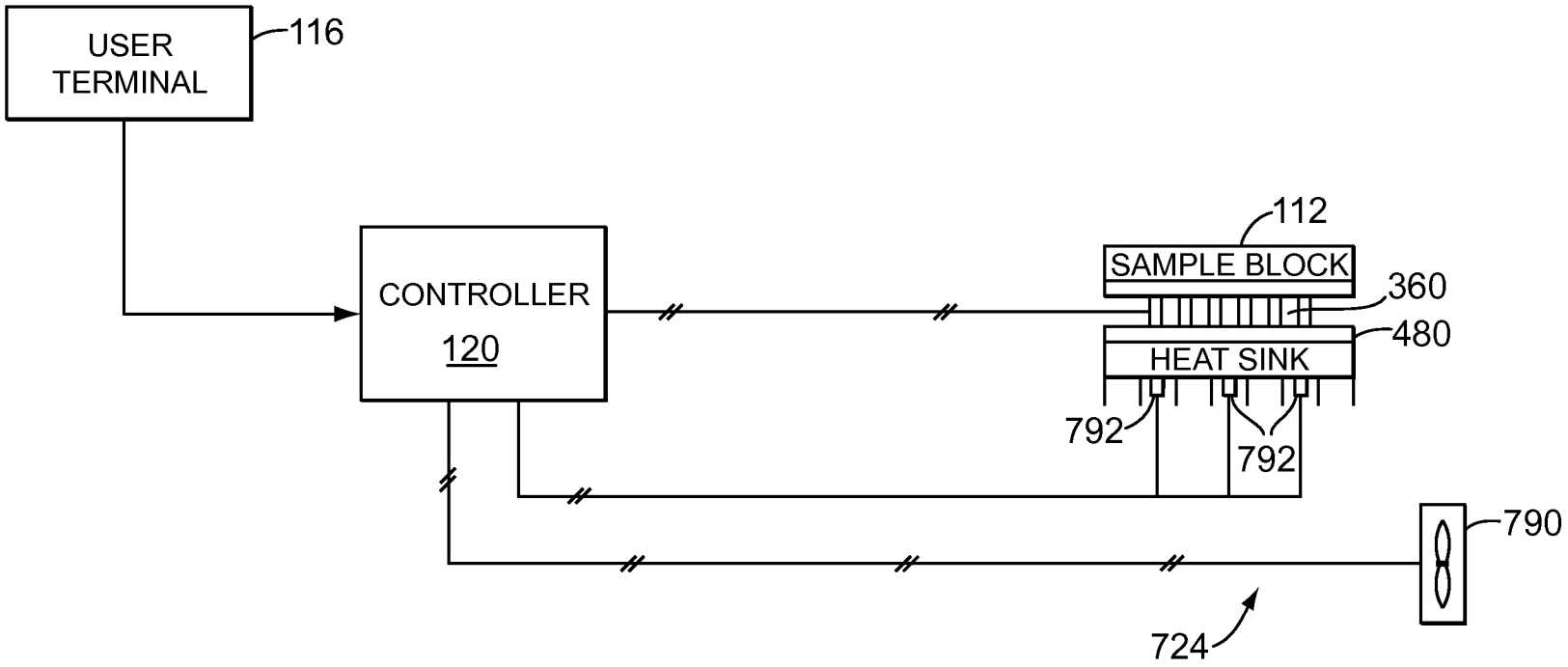
FIG. 7 is a block diagram of an exemplary embodiment of a cooling system of a thermal cycler in accordance with aspects of the disclosure.

As shown in FIG. 7, according to various exemplary embodiments, a cooling system 724 can include one or more cooling members 792 configured to generate and/or direct cool air toward the heat sink 480 and/or to absorb heat from the heat sink 480. According to some aspects, one or more of the cooling members 792 can be mounted within the cooling fins 486 associated with a region of the sample block 112 so as to cool that specific region, as discussed below. According to some aspects, cooling system 724 can also include a conventional fan 790 to control the heat sink temperature.

Although the exemplary embodiments of FIGS. 5-7 show the use of a Peltier device 360 and heat sink 480, various other exemplary embodiments may include a cooling system comprising a cooling member that replaces the Peltier device and heat sink. Further, in systems wherein direct circulation of fluid around the sample holders is used for heating and/or cooling, a cooling system having a cooling member may be used in lieu of or in addition to such fluid circulation.

Figure 10:
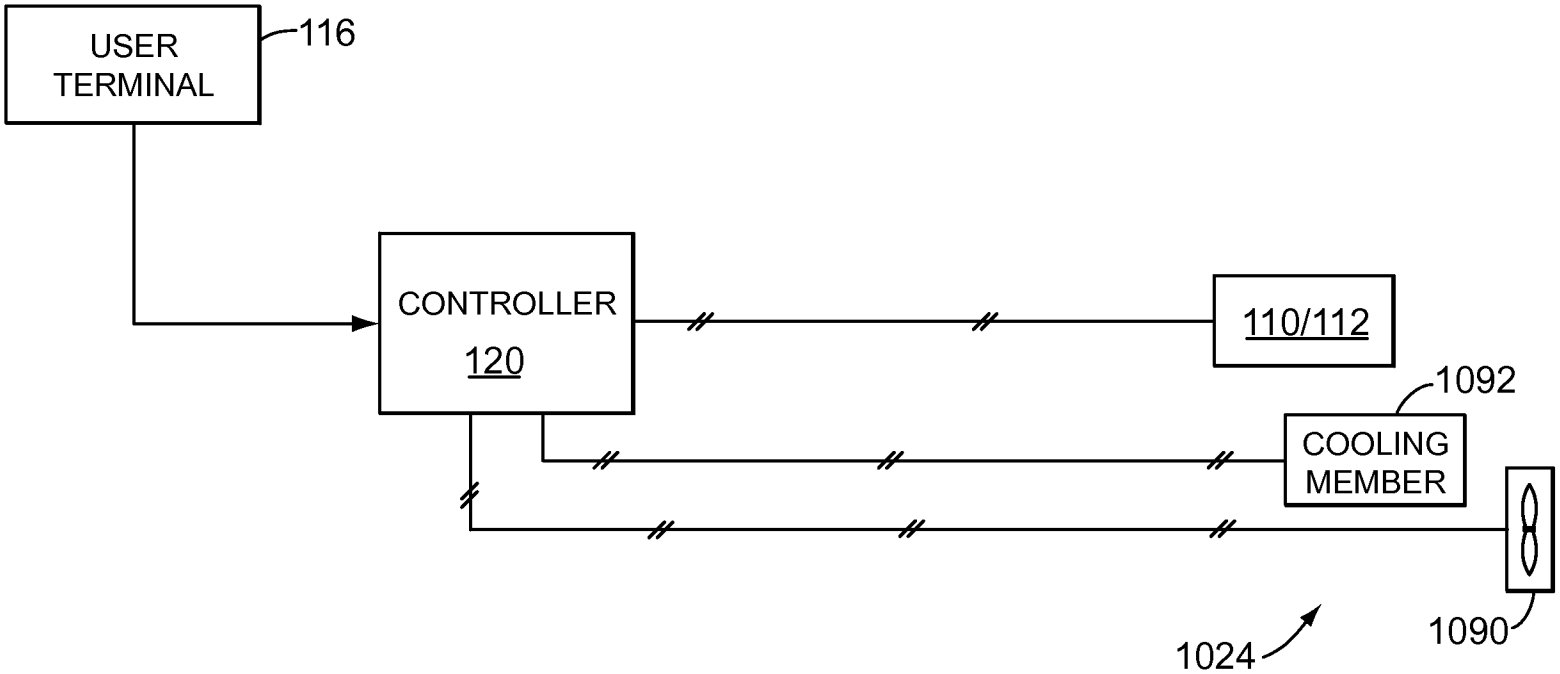
FIG. 10 is a block diagram of yet another exemplary embodiment of a cooling system of a thermal cycler in accordance with aspects of the disclosure.

FIG. 10 depicts an exemplary embodiment of a cooling system 1024 comprising a cooling member 1092 and a conventional fan 1090. The cooling system 1024 may be configured to reduce the temperature of sample block 112 or of sample holder 110 directly. The cooling member 1092 may thus be configured to output a cooling fluid such as, for example, CO2 (bottled or dry), liquid nitrogen, pressurized air, water, or the like, in a manner similar to one or more of the cooling members 592, 692, 792. The cooling system 1024 also may be used in conjunction with a heating system (not shown in FIG. 10), such as, for example, the heating systems described herein, configured for raising the temperature of the block 112 or the sample holder directly. It will also be appreciated by those having skill in the art that, in accordance with various exemplary embodiments, the cooling systems 1024 may be used as the heating system as well, depending, for example, on the type of cooling member 1092 that may be used. Moreover, although the exemplary embodiments of FIGS. 5-7 and 10 illustrate a conventional fan 590, 690, 790, or 1090 used in conjunction with the cooling systems 524, 624, 724, or 1024, such a fan need not be utilized.

According to various exemplary aspects, the cooling member 592, 692, 792, or 1092 may utilize heat pipe technology to conduct and/or remove heat. Heat pipes may have relatively high thermal conductivity (e.g., over one thousand times more conductive than copper) and a relatively flexible configuration so as to be capable of adapting to various physical environments. Due to such high thermal conductivity, heat pipe technology may reduce the delay between the heating/cooling source (e.g., Peltier device 360 and heat sink 480) or a resistive heater (not shown) and the load (e.g., sample block 112), as well as improve thermal uniformity throughout the sample block 112. In various exemplary embodiments, one or more heat pipes, for example, any number of pipes ranging from about 1 to about 10, may be used to transfer heat from the heat sink 480, from the sample block 112, and/or from the sample holders.

The use of heat pipes also may facilitate the proportional integral derivative (PID) control of the temperature and/or provide a higher precision temperature stability and uniformity. As discussed above, the ability to minimize temperature nonuniformities and maintain the sample block 112 and/or sample holders 110 at a substantially uniform temperature may be desirable in many circumstances so as to be able to maintain the samples at a uniform reaction temperature.

Figure 11:
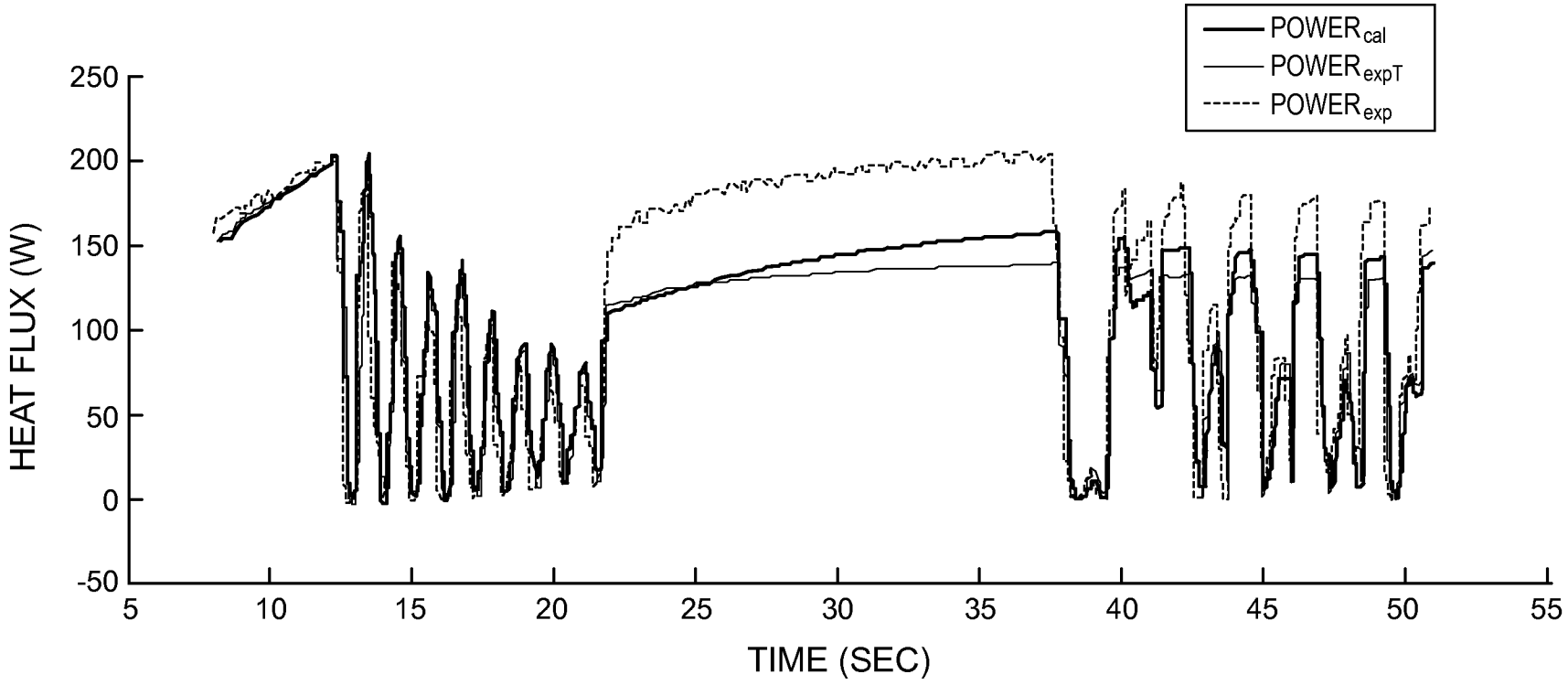
FIG. 11 is a graph that contains various power versus time curves for a thermal cycling system using conventional heat sink and fan combination cooling.

It also may be desirable to use a cooling system that has a relatively low thermal resistance, for example, in order to maintain the temperature of the heat sink 480 at approximately 45° C., as mentioned above. By way of example, assuming an ambient temperature of about 30° C. inside a PCR instrument and a dissipated power of about 100 W, a desirable thermal resistance may be no greater than about 0.15° C./W. An average dissipated power of about 100 W may be assumed based on the results shown in FIG. 11 of power versus time determined for a thermal cycling system having the basic setup shown in the block diagram of FIG. 1A, using a conventional heat sink and fan combination for cooling. More specifically, the thermal cycling system used to generate the results in FIG. 11 was a variation of the 7900HT Fast Real-Time PCR System from Applied Biosystems, Inc., with modified electronics and software, an XLT 2393 Peltier device from Marlow Industries, a portion of the heat sink (obtained by cutting) from the 7900 HT thermal cycling system, and a fan having a flow rate of about 120 cubic feet per minute. The power (e.g., heat flux) curves shown in FIG. 11 correspond to the calculated power dissipation based on measured current in the system (Power_cal), the calculated power dissipation based on measured current and temperatures in the system (Power_expT), and the measured power consumed during the thermal cycling (i.e., power=voltage*current) (Power_exp).

Using a conventional cooling system in the form of a heat sink and fan to achieve such a relatively low value of thermal resistance as that indicated above requires a heat sink of relatively large dimensions and a relatively powerful, and thus relatively loud, fan. Moreover, various structural arrangements and/or a relatively powerful fan may need to be provided to achieve effective circulation of air in and around the heat sink, since, for example, the heat sink (e.g., heat sink block and fins) are typically disposed underneath and in alignment with (e.g., aligned with the longitudinal axis of) the Peltier device, sample block, and/or samples. That is, as discussed above, the heat sink is typically positioned at a substantially central location of the thermal cycling instrument.

In contrast, heat pipes can achieve relatively low thermal resistances due to the relatively high thermal conductivity exhibited by heat pipe coolers. Also, when using one or more heat pipes as a cooling member, such as, for example, cooling member 592, 692, 792 or 1092, the heat sink (e.g., heat sink block and cooling fins) may be placed farther (e.g., offset) from the cooling area, the sample holders, and/or the sample block. This may provide greater flexibility in the arrangement of the thermal cycling system, reduction in the overall size of the instrumentation, and/or more efficient cooling.

When using heat pipe technology, the heat sink may have dimensions ranging from about 40 mm by about 40 mm to about 80 mm by about 120 mm, for example. The fan may have a noise level ranging from about 15 dBA to about 60 dBA, for example.

Figure 12:
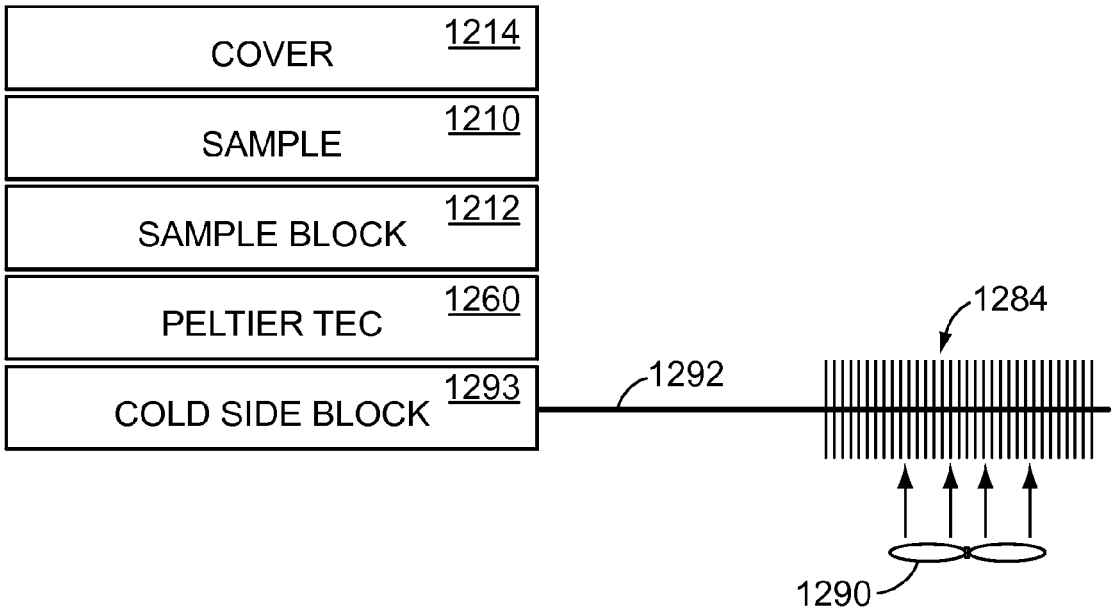
FIG. 12 is a block diagram of a thermal cycler with a cooling system utilizing heat pipe technology in accordance with aspects of the disclosure.

With reference to FIG. 12, for example, a block diagram of an exemplary embodiment of a PCR thermal cycling system that uses heat pipe technology as the cooling member is depicted. In FIG. 12, many of the components are similar to those discussed with reference to FIG. 1A, however, the control components, for example, like those in FIG. 1A, are not depicted. Skilled artisans would understand that such control components may be utilized to control the thermal cycling times and temperatures in accordance with the teachings herein.

The system of FIG. 12 thus includes a heated cover 1214 to cover the samples 1210 and a sample block 1212 configured to support the samples 1210. Suitable structures for the cover 1214, samples 1210, and sample block 1212 are described above with reference to FIGS. 1-4 and may be used with the embodiment of FIG. 12. The system of FIG. 12 further includes, according to various exemplary embodiments, a Peltier thermoelectric device 1260 for heating and cooling the sample block 1210 and a cold side block 1293 into which the evaporative side of one or more heat pipes 1292 may be in thermal contact. In an alternative arrangement (not shown), one or more heat pipes 1292 may be placed in direct thermal contact with the Peltier device 1260. In FIG. 12, the one or more heat pipes 1292 may be attached to a cold side block 1293 at one end of the heat pipes 1292 (e.g., the end of the heat pipes 1292 where a coolant is vaporized) and attached to a heat sink 1284 (e.g., shown as fins in FIG. 12) at the other end of the heat pipes 1292 (e.g., the end where condensed coolant is collected and circulated back to the opposite end). A fan 1290 may be positioned so as to circulate air in and around the fins 1284. It should be understood that the heat sink 1284 may include a heat sink block connected to fins in a structural arrangement similar to the heat sink 480 shown in FIG. 4.

Thus, according to various exemplary embodiments and as depicted in FIG. 12, using heat pipe technology as a cooling member to provide cooling in a thermal cycling system may permit greater flexibility in the arrangement of the heat sink relative to the rest of the thermal cycling system and/or may permit air to be circulated in and around the heat sink in a more optimal manner. By way of example, the heat sink may be provided in an offset relationship to (e.g., not aligned with) a Peltier device, sample block, and/or samples of the thermal cycling system. For example, the heat sink may be positioned between a longitudinal axis of the Peltier device, sample block, and/or samples (sample holder) and a fan, including in alignment with the fan, as shown in the exemplary arrangement of FIG. 12. Such positioning of the heat sink out of alignment with the Peltier device, sample block, and/or sample holders may permit an air path between a fan and the heat sink to be reduced, thereby permitting a relatively less powerful, and thus less noisy, fan to be used. Moreover, positioning the heat sink away from the center of the thermal cycling instrument, for example, between a longitudinal axis of the sample block and/or sample holder and a fan, and/or proximate a periphery of the instrument and offset from the Peltier device, sample holder and/or sample block, may permit elimination of the fan. That is, the heat sink's proximity to the ambient air may provide sufficient heat transfer and cooling of the heat sink without the need for a fan.

As discussed above, using heat pipe cooling may permit a relatively quiet fan to be used in conjunction with the cooling system. Further, using heat pipe technology may permit the use of higher power Peltier devices, thereby resulting in faster and more efficient thermal cycling. That is, due to their relatively low thermal resistance, heat pipes may dissipate heat more than conventional heat sinks of approximately equal size and permit Peltier devices of higher power to be used for heating the samples. Further, more efficient removal of heat may occur with heat pipes due to the flexibility in placement of the fins and heat block of a heat sink, for example, by permitting the fins and/or heat block to be distanced from the Peltier device and achieving improved circulation of air or other cooling medium around the fins and/or heat block.

As mentioned above, heat pipes for use in cooling in thermal cyclers utilize a phase change of a coolant from liquid to vapor inside the pipe. In various exemplary embodiments, the coolant may be water or a refrigerant. The pipes include a hot side (e.g., condenser end) and a cold side (e.g., evaporator end). The hot side may be in thermal communication with a heat sink to transfer heat from the heat pipe or the hot side may be cooled by directly circulating a cooling fluid (e.g., air, water, etc.) around the heat pipe hot side. Condensed liquid may circulate through the heat pipe from the hot side to the cold side. In various embodiments, internal surface portions of the heat pipe may be lined with a wicking material capable of capillarity such that the condensed liquid travels via the wicking material from the hot side to the cold side. Other mechanisms for circulating the condensed liquid also may be used, such as, for example, relying on gravity, pumps, or other mechanisms known to those skilled in the art. The physics and principles of operation of heat pipe technology are known to those skilled in the art and have been used for cooling in various computer systems, including, for example, notebook computers. Suitable heat pipe configurations include straight heat pipes, for example with vapor flowing in the center region in one direction and condensed liquid traveling around interior peripheral surface portions (e.g., via the wicking material) of the pipe in the opposite direction. In various alternative embodiments, heat pipes may be U-shaped or form a loop. Other curved heat pipe configurations also may be utilized.

Embodiments of heat pipe cooling systems that may be used as the cooling member 592, 692, 792, 1092, or 1292 include those marketed by Thermacore International (Lancaster, Pa.), which comprise a vacuum tight envelope, a wick structure and a working fluid. The heat pipe may be evacuated and back-filled with a small quantity of working fluid so as to saturate the wick. Inside the heat pipe, a vapor-liquid equilibrium is established. As heat enters the pipe at one end, the equilibrium is upset and generates vapor at a slightly higher pressure. This higher pressure vapor travels to the other condensing end where the slightly lower temperatures cause the vapor to condense and give up its latent heat of vaporization. Condensed fluid is then pumped back to the evaporator end by capillary forces developed in the wick structure. This continuous cycle transfers large quantities of heat with very low thermal gradients. For further information regarding Thermacore International's heat pipe technology, reference is made to http://www.thermacore.com/hpt.htm and http://www.electronics-cooling.com/Resources/EC_Articles/SEP96/sep96_02.htm.

In various other embodiments, heat pipe coolers manufactured by Cooler Master Co., Ltd. of Taiwan, such as the Hyper 6 KHC-V81 model, and/or by Thermaltake Co., Ltd., such as the Big Typhoon model, may be used as the cooling member 592, 692, 792, 1092, or 1292. For further information on these heat pipe coolers, reference is made to http://www.coolermaster.com/index.php?LT=english&Language_s=2&url_place=product&p_serial=KHC-V81 and http://www.thermaltake.com/coolers/4in1heatpipe/cl-p0114bigtyphoon/cl-p0114.htm, respectively.

Figure 17:
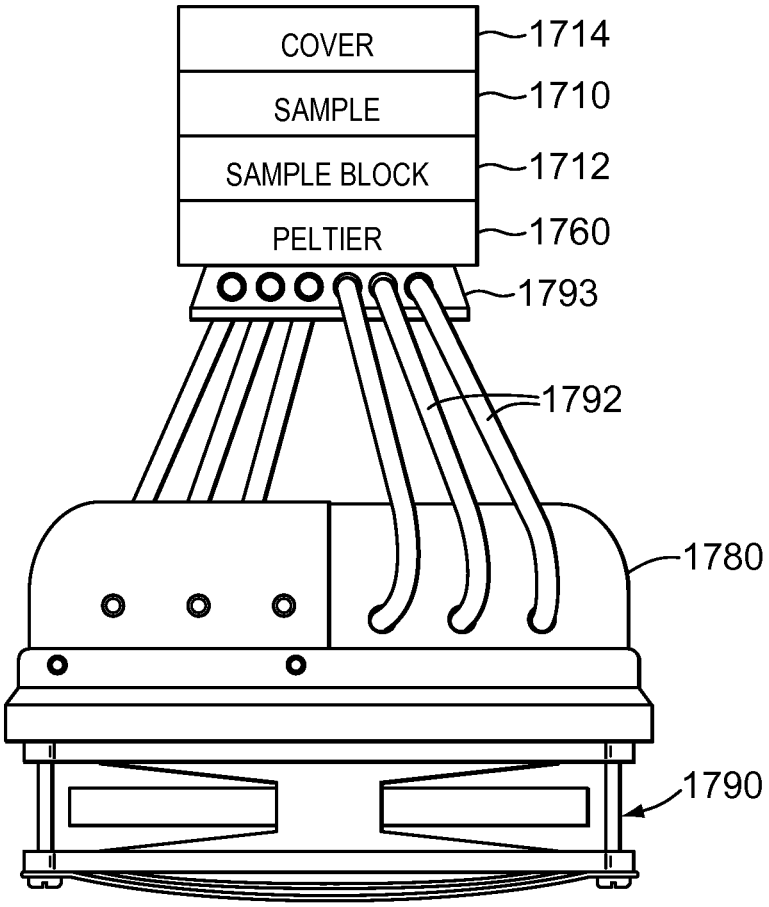
FIG. 17 is a block diagram of a thermal cycling system and a schematic perspective view of a cooling system utilizing heat pipe technology according to exemplary aspects of the disclosure.

FIG. 17 illustrates an exemplary embodiment of a cooling system that includes heat pipes, a heat sink, and cooling fan having substantially the same arrangement as Thermaltake's Big Typhoon model for cooling in a thermal cycling system, components of which are illustrated in block form in FIG. 17. In the exemplary embodiment of FIG. 17, therefore, the thermal cycling components include a heated cover 1714 placed over samples 1710 (which may be contained in various types of sample containers in accordance with the teachings herein), a sample block 1712 configured to hold the samples 1710, and a Peltier thermoelectric device 1760. A plurality of heat pipes 1792 are placed in thermal contact with the Peltier device 1760 at one end of the heat pipes 1792 so as to absorb heat from the thermal cycling system and vaporize the circulating coolant in the heat pipes 1792. In the exemplary arrangement of FIG. 17, the heat pipes 1792 are placed in a block 1793 that can form a planar surface which facilitates attachment to the Peltier device 1760. However, it should be understood that the heat pipes 1792 also may be placed directly in contact with the Peltier device 1760. The other end of the heat pipes 1792 are in thermal contact with a heat sink 1780. A fan 1790 is positioned beneath the heat sink 1780 in FIG. 17 to circulate air to cool the heat sink 1780. The heat pipes 1792 therefore exchange heat with the heat sink 1780 to condense the coolant circulating in the heat pipes 1792. As described above, the condensed coolant then travels back to the opposite end of the heat pipes 1792 in thermal contact with the other components of the thermal cycling system. By way of example, the condensed coolant may travel via a wicking material provided in the heat pipes, although other mechanisms for circulating the condensed coolant also may be used, as known to those skilled in the art.

Although in the exemplary embodiment of FIG. 17, the heat pipes 1792 are in thermal contact with a Peltier thermoelectric device 1760, it should be understood that the heat pipes 1792 also may be in thermal contact with the sample block 1712, samples 1710, and/or other heating and/or cooling elements of a thermal cycler, for example, in embodiments wherein the thermal cycler does not include a Peltier device. Also, although the exemplary embodiment of FIG. 17 depicts the heat sink 1780 and fan 1790 substantially in alignment (e.g., along a longitudinal axis) with the various thermal cycling components 1710, 1712, 1760, and 1714, it should be understood that the heat sink 1780 and fan 1790 may be offset from the thermal cycling components, similar to that described above and shown with reference to FIG. 12, for example. For example, the heat pipes 1792 may be arranged and configured such that the heat sink 1780 and fan 1790 are disposed to a side of the thermal cycling components. 1710, 1712, 1760, and 1714.

FIG. 16 is a table that includes data pertaining to air volume, noise level, and thermal resistance of conventional heat sinks and fan combinations (items 1-3) that may be used for thermal cycling cooling and commercially available heat pipe coolers and fans (items 7-11) that may be used for thermal cycling cooling in accordance with the disclosure herein. Items 4 and 6 correspond respectively to Thermaltake's Big Typhoon /Heat Pipe cooler and fan and to Cooler Master's Hyper 6 Heat Pipe cooler and fan. In items 5 and 7, the fans that come with the commercially available Hyper 6 and Big Typhoon heat pipe coolers were replaced with the fans indicated in FIG. 16 for those items. As can be seen by the data provided in FIG. 16, commercially available heat pipe coolers and fan combinations are capable of achieving relatively low thermal resistances (e.g., less than 15° C./W) at relatively low fan noise levels (e.g., 16 dBA and 20 dBA, respectively, for items 4 and 6). Conventional heat sink and fan combinations require louder fans to achieve relatively low thermal resistances, as can be seen, for example, by the data corresponding to items 2 and 3 in FIG. 16.

Figure 13:
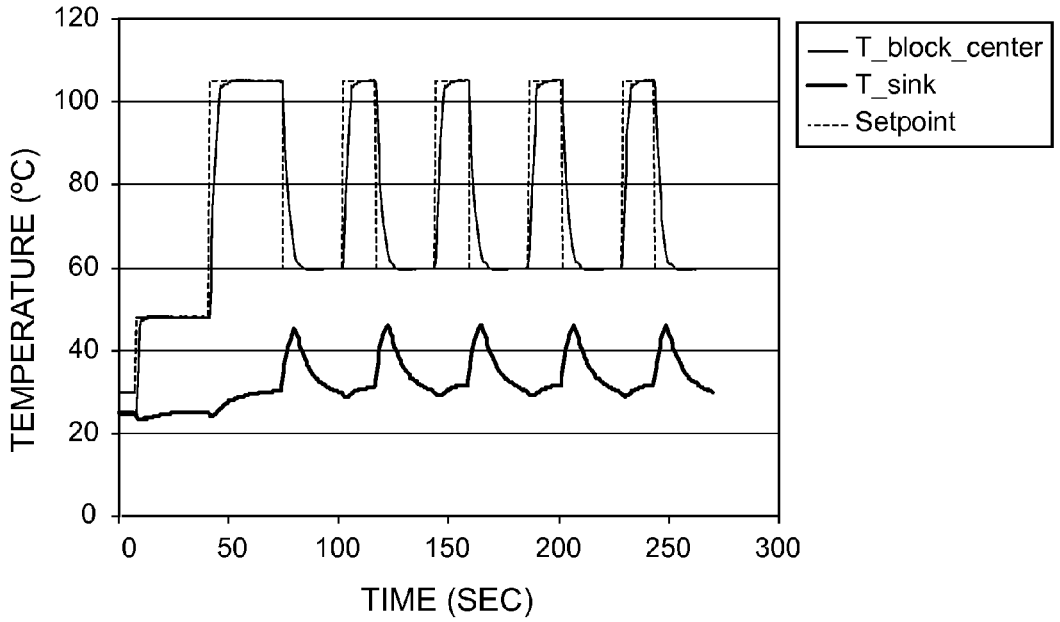
FIG. 13 is a graph showing various temperature versus time curves in a thermal cycling system using conventional heat sink and fan combination cooling.
Figure 14:
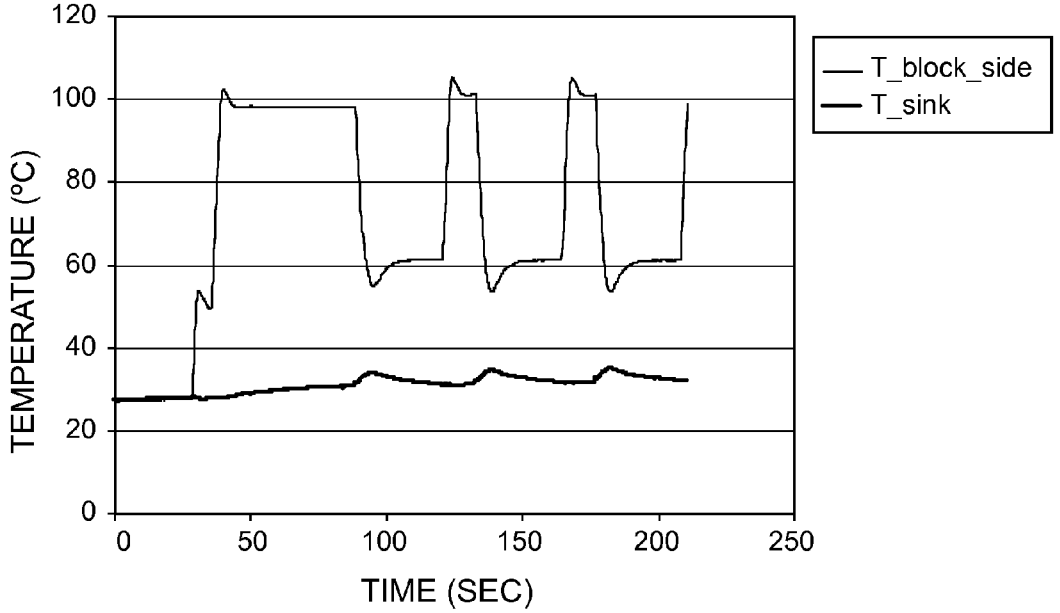
FIG. 14 is a graph showing various temperature versus time curves in a thermal cycling system utilizing heat pipe cooling in accordance with aspects of the disclosure.
Figure 15:
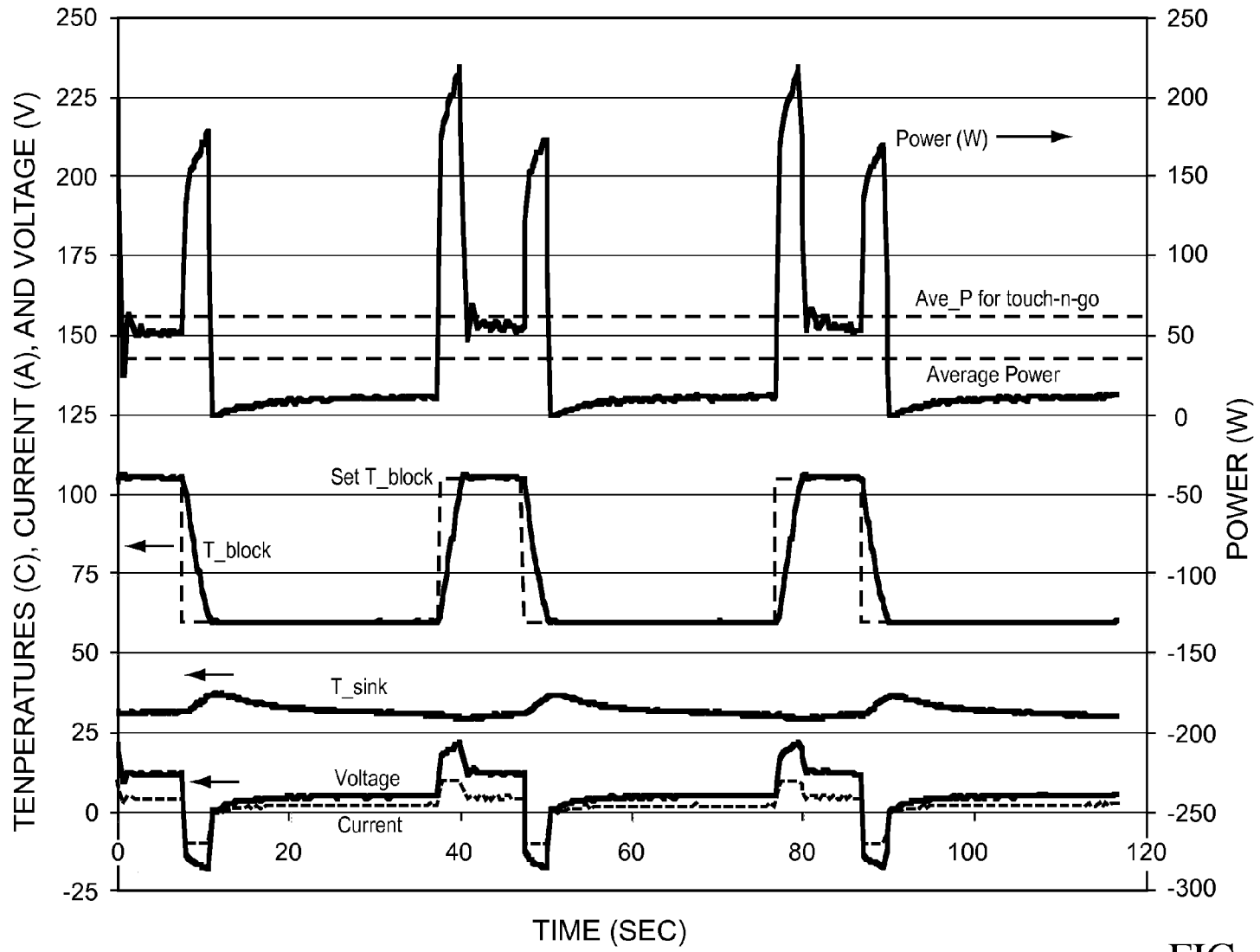
FIG. 15 is a graph showing various power, temperature, voltage, and current versus time curves in a thermal cycling system utilizing heat pipe cooling in accordance with aspects of the disclosure.

FIGS. 13-15 are graphs showing data from PCR thermal cycling experiments using conventional heat sink/fan combination cooling and using heat pipe cooling. With reference to FIG. 13, temperature versus time curves are shown for the PCR thermal cycling system using a conventional heat sink and fan combination as the cooling system, as described above with reference to FIG. 11. Thus, the PCR thermal cycling system used to obtain the data in FIG. 13 used a setup similar to the block diagram of FIG. 1A, with the heating system 156 in the form of a Peltier device and the cooling system 124 in the form of a conventional heat sink and fan with the heat sink block in contact with the Peltier device.

More specifically, the graph of FIG. 13 depicts the setpoint temperature (e.g., the desired temperature programmed into the system for thermal cycling of the samples) of the sample block (corresponding to "Setpoint"), the actual sensed temperature of the sample block (corresponding to "T_block_center"), and the sensed temperature of the heat sink block (corresponding to "T_sink").

Referring now to FIG. 14, temperature versus time curves are shown for a PCR thermal cycling system using heat pipes for cooling in accordance with various exemplary embodiments. In particular, the results shown in FIG. 14 correspond to the PCR thermal cycling system used for the results of FIG. 13, except the conventional heat sink/fan cooling system was replaced with a Thermaltake Big Typhoon cooler including the Thermaltake Stock Fan TT-1225 supplied with that cooler. The PCR thermal cycling system used for the results shown in FIG. 14 had a setup similar to the block diagram depicted in FIG. 12, with the heat sink fins being offset from the remaining components of the thermal cycler. The setpoint temperature for the sample block depicted in FIG. 13 also was used for the experiment corresponding to FIG. 14.

FIG. 14 shows the sensed temperature of the sample block (corresponding to "T_block_side") and the sensed temperature of the heat sink block (corresponding to "T_sink"). As shown by the results of FIG. 14, the temperature of the heat sink block, T_sink, is relatively low compared to the temperature of the heat sink block measured and shown in the results in FIG. 13. Moreover, the temperature variation of the heat sink in FIG. 14 is relatively uniform, whereas the temperature variation in FIG. 13 is relatively significant. The relatively low and uniform temperature results of FIG. 14 can be attributed to the relatively low thermal resistance of heat pipes. Based on the relatively low temperature profile and minimal variation of the heat sink when using heat pipes for cooling in a PCR thermal cycler, as shown in FIG. 14, it may be possible to remove more heat from the system, thereby achieving relatively fast thermal cycling times. Also, when using heat pipes, a quieter fan may be used to achieve the same temperature of the heat sink than when using a conventional heat sink and fan combination for cooling.

FIG. 15 shows additional results obtained from a PCR thermal cycling experiment which used the same thermal cycling system as described above with reference to FIG. 14. The time/temperature profile used for the results of FIG. 15 is indicated by the dashed curve labeled Set T_block. In particular, FIG. 15 depicts three power versus time curves corresponding to power supplied to the Peltier thermoelectric cooler. The power curves show the measured peak power (corresponding to the curve labeled "Power (W)"), the measured average power of the system (corresponding to the lower dashed curve labeled "Average Power"), and the average power measured by cycling rapidly between two temperatures (corresponding to the upper dashed curve labeled "Ave_P for touch-n-go"). The two temperatures for the cycling, as indicated by the Set T_block curve, were about 60° C. and 105° C. The values of the various power curves described above are measured in Watts (W) along the right hand vertical axis in FIG. 15, with time measured in seconds along the horizontal axis. Based on the results for power shown in FIG. 15, the average power was measured to be about 40 W and the peak power about 220 W. These power measurements correspond to the power generated by the Peltier device, with the assumption that this power is eventually dissipated by the heat sink.

FIG. 15 also shows three temperature versus time curves, with the temperature values being provided in degrees Celsius ("Temperature (C)") on the left hand vertical axis in FIG. 15 and the time being provided in seconds on the horizontal axis. The temperature versus time curves in FIG. 15 include the setpoint temperature of the sample block during the thermal cycling experiment (corresponding to "Set T_block"), the actual sensed temperature of the sample block (corresponding to the upper solid curve labeled "T_block"), and the actual sensed temperature of the heat sink (corresponding to the lower solid curve labeled "T_sink"). Similar to the results of FIG. 14, the temperature of the heat sink in the experiment of FIG. 15, again utilizing heat pipes for cooling, was relatively low and relatively uniform (e.g., had relatively little variation). Regarding the latter, the maximum temperature rise of the heat sink was about 10° C. As mentioned above, the results shown in FIG. 15 can be used to estimate the power dissipated by the heat sink and the temperature of the cold side of the Peltier (i.e., the heat sink block). Based on the results in FIG. 15, it may be desirable to maintain the temperature of the heat sink block, T_sink, less than or equal to about 45° C. to achieve efficient thermocycling using the system used for the experimental results in FIG. 15.

In addition to the above results, FIG. 15 contains curves of voltage versus time and current versus time supplied to the Peltier thermoelectric cooler. Both the voltage values measured in volts ("Voltage (V)") and the current values measured in amps ("Current (A)") are displayed on the left hand vertical axis in FIG. 15 and the time is measured in seconds on the horizontal axis.

Although the various cooling systems discussed above, such as those that utilize heat pipes, may reduce temperature nonuniformity experienced by the samples during temperature cycling of the samples through the various incubation stages, in some applications it may be desirable to induce controlled (e.g., predetermined) temperature gradients among the samples during the PCR protocol. It is envisioned that the various exemplary heat pipe embodiments described above will assist in achieving desired temperature gradients due to the ability to exert greater control over the cooling effects of heat pipes. Thus, by controlling the heat pipes, for example, independently of each other through the controller and various bus lines and sensors, various regions of the sample holders 110, 1210, or 1710, the sample block 112, 1212, or 1712, and/or the heat sink may be cooled by different amounts and/or rates in order to achieve desired temperature gradients among some or all of the samples 110, 1210, or 1710.

In some exemplary embodiments, carbon may be utilized to enhance temperature uniformity throughout the sample block 112, 1212, or 1712. Since carbon transfers heat in two dimensions as opposed to three, it may be used to assist in heat transfer and in minimizing undesirable temperature variations throughout the sample block. By way of example, the heat sink, including, for example, the heat sink fins, may comprise (e.g., be made from) carbon and/or carbon may be provided as an intermediate layer between the heat sink and any of the cooling members described herein, including, for example, cooling members 592, 692, 792, 1092, or 1292 described below. In other exemplary embodiments, carbon may be provided between a thermoelectric device and the heat sink block.

Figure 8:
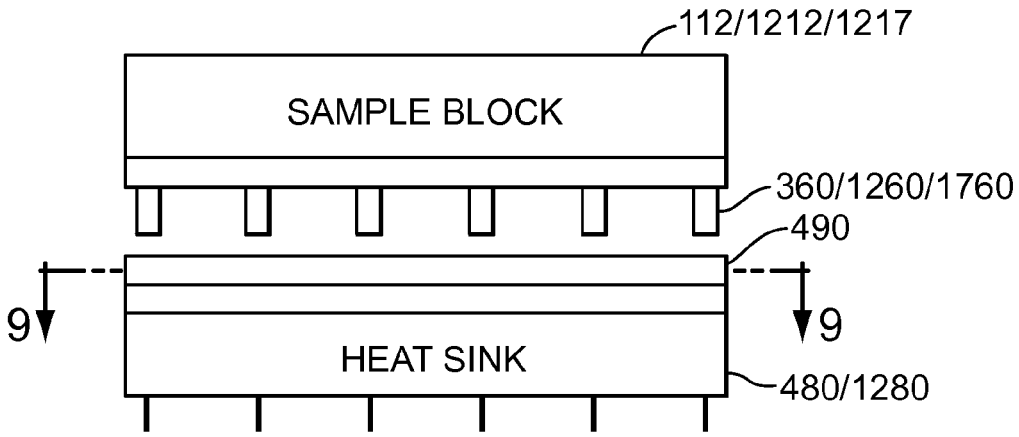
FIG. 8 is a block diagram of an exemplary heat sink, carbon block, and sample block in accordance with aspects of the disclosure.
Figure 9A:
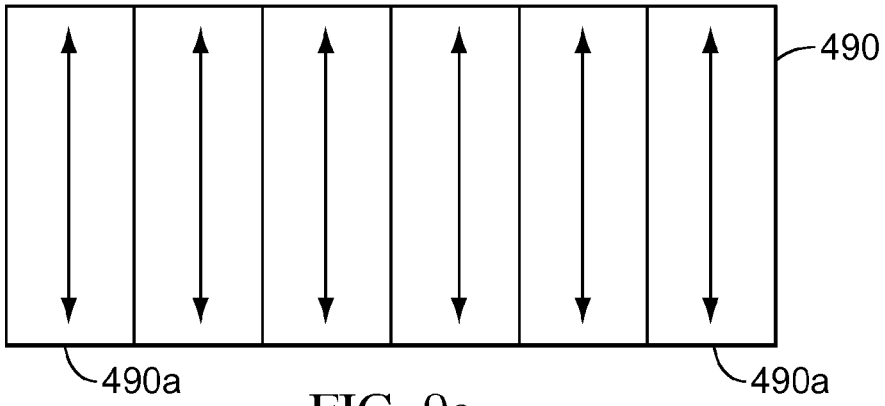
FIGS. 9*a*-9*b* are views of exemplary embodiments of the carbon block taken along line 9-9 of FIG. 8.
Figure 9B:
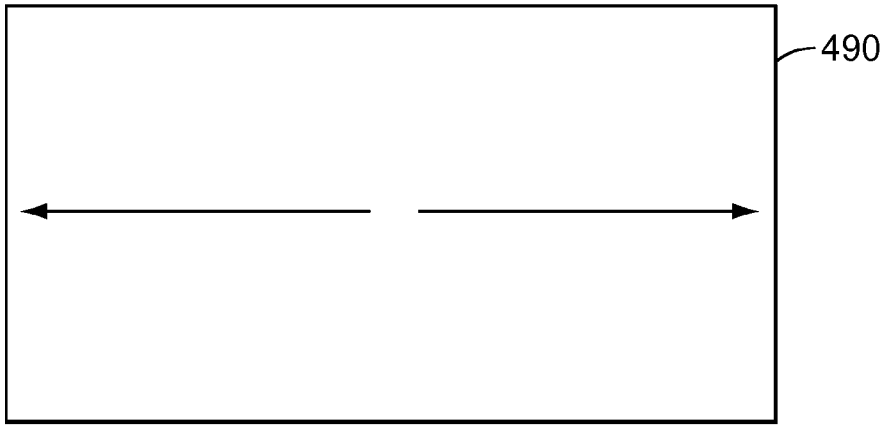

As depicted in FIG. 8, in some exemplary embodiments, the carbon may be substantially in the form of a block 490 provided as a layer between the thermoelectric device 360, 1260, or 1760 and heat sink 480 or 1280 (or between the thermoelectric device and heat pipe block 1293 or 1793 (not shown in FIG. 8)). The block 490 may be oriented so as to conduct heat in a vertical direction away from the sample block 112, 1212, or 1712 although other orientations may be selected depending on the application and desired heat conduction. By way of example only, as shown in FIG. 9*a*, which is a view taken from line 9-9 in FIG. 8, the block 490 may comprise six 2×8 segments 490*a* forming a block 490 having overall 12×8 dimensions that correspond to the 12×8 sample block 112, 1212, or 1712. Aside from conducting heat in a vertical direction (i.e., away from or toward the sample block 112, 1212, or 1712), conduction in each segment 490*a* may take place along the long axis (i.e., in the direction of the arrows shown in FIG. 9*a*). In this manner, the end segments (e.g., the end segments 490*a* to the left and the right of the center of the block) would have a similar environment (e.g., temperature) as the center segments, which may minimize temperature variations between the center and end samples in the sample block 112, 1212, or 1712. In another example, depicted in FIG. 9*b*, which also is view taken from line 9-9 in FIG. 8, the block 490 may be formed as a single piece and may be oriented so as to conduct heat in the vertical direction and along the long axis of the block 490, as depicted by the arrows in FIG. 9*b*. This orientation may minimize temperature variations across the sample block 112, 1212, and 1712 (e.g., along a direction substantially perpendicular to the arrows shown in FIG. 9*b*.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a range of "less than 10" includes any and all subranges between (and including) the minimum value of zero and the maximum value of 10, that is, any and all subranges having a minimum value of equal to or greater than zero and a maximum value of equal to or less than 10, e.g., 1 to 5. In some cases, the numerical values as stated for the parameter can take on negative values. In this case, the example value of range stated as "less that 10" can assume negative values, e.g. −1, −2, −3, −10, −20, −30, etc.

It is noted that, as used in this specification and the appended claims, the singular forms "a," "an," and "the," include plural referents unless expressly and unequivocally limited to one referent. Thus, for example, reference to "a biological" includes two or more different biological samples. As used herein, the term "include" and its grammatical variants are intended to be non-limiting, such that recitation of items in a list is not to the exclusion of other like items that can be substituted or added to the listed items.

It will be apparent to those skilled in the art that various modifications and variations can be made to the sample preparation device and method of the present disclosure without departing from the scope its teachings. Other embodiments of the disclosure will be apparent to those skilled in the art from consideration of the specification and practice of the teachings disclosed herein. It is intended that the specification and examples be considered as exemplary only.

The invention claimed is:

1. A device for biological sample processing, the device comprising:

a sample holder configured to receive a biological sample;

a heating system configured to raise the temperature of the biological sample;

a cooling system configured to lower the temperature of the biological sample, the cooling system comprising a fan and a heat sink, wherein the cooling system and the heating system comprise an integral system further comprising one or more thermoelectric devices ;

a heat pipe positioned between the heating system and the cooling system, wherein the heat pipe, heating system and cooling system are vertically stacked, wherein the heat pipe further contacts both the heating system and the cooling section system and comprises an evaporative portion and a condensing portion; and a controller configured to operably control the heating system and the cooling system to cycle the device through a desired time-temperature profile.

2. The device of claim 1, wherein the heat pipe comprises at least one recirculating cooling fluid mechanism.

3. The device of claim 2, wherein the recirculating cooling fluid mechanism is configured to recirculate a cooling fluid to remove heat from a location in thermal communication with the biological sample.

4. The device of claim 3, wherein the recirculating cooling fluid mechanism is configured to recirculate a cooling fluid to remove heat from a location in thermal communication with the thermoelectric device.

5. The device of claim 1, wherein the heat sink comprises a heat sink block and fins.

6. The device of claim 1, wherein the fan is positioned so as to circulate air in and around the heat sink.

7. The device of claim 1, further comprising:

a sample block configured to be placed in thermal contact with the sample holder.

8. The device of claim 7, wherein the sample block comprises at least one recess configured to receive the sample holder.

9. The device of claim 1, wherein the sample holder comprises one of a microtiter plate, a microcard, a plurality of capillaries and a plurality of tubes.

10. The device of claim 1, wherein the device is configured to perform one of polymerase chain reactions, amplification, ligase chain reactions, antibody binding reactions, oligonucleotide ligation assays and hybridization assays.

11. The device of claim 1, wherein the biological sample comprises a nucleic acid sample.

12. The device of claim 1, wherein the heat sink and the sample holder are positioned proximate to a center of the device.

* * * * *